United States Patent [19]

Kopich et al.

[11] 3,937,603

[45] Feb. 10, 1976

[54] ROTARY MACHINE APEX SEAL

[75] Inventors: Leonard F. Kopich, Madison Heights; Gino DiPace, Detroit, both of Mich.

[73] Assignee: General Motors Corporation, Detroit, Mich.

[22] Filed: Aug. 29, 1974

[21] Appl. No.: 501,792

[52] U.S. Cl. ..... 418/117; 418/121; 418/122

[51] Int. Cl.[2] ..... F01C 19/04; F04C 27/00

[58] Field of Search ..... 418/113, 116–118, 418/120–123

[56] References Cited

UNITED STATES PATENTS

| | | | |
|---|---|---|---|
| 3,205,872 | 9/1965 | Pomasanow | 418/122 |
| 3,740,175 | 6/1973 | Kell | 418/122 |
| 3,794,450 | 2/1974 | Klomp | 418/122 |

FOREIGN PATENTS OR APPLICATIONS

| | | | |
|---|---|---|---|
| 1,247,094 | 8/1967 | Germany | 418/118 |
| 1,189,789 | 3/1965 | Germany | 418/118 |

*Primary Examiner*—John J. Vrablik

*Attorney, Agent, or Firm*—Ronald L. Phillips

[57] ABSTRACT

A rotary machine multi-piece apex seal arrangement having two arcuate main body segments with sliding tongue and slot engagement which are biased to pivot in opposite directions to engage an internal peripheral wall of the machine by a single spring that is positioned by a bar sliding on this wall and also having end segments that are wedged against the main body segments by the same spring to engage oppositely facing end walls in the machine.

2 Claims, 8 Drawing Figures

ROTARY MACHINE APEX SEAL

This invention relates to rotary machine apex seals and more particularly to rotary machine multi-piece apex seals having multiple sealing edges.

In rotary machines such as rotary combustion engines, pumps, compressors, and the like wherein apex seals are provided on the rotor to engage an internal peripheral wall and also possibly the end walls in the machine to separate the machine's working chambers which rotate with the rotor, there are more demands on such sealing as compared with that in reciprocating piston engines since in the former leakage is to be avoided between the working chambers whereas in the latter case, leakage is normally to the crankcase rather than adjacent chambers. Furthermore, in such rotary machines, the angle between the apex seal and the peripheral wall normally changes as the rotor rotates because of the changing radius of curvature of this wall and the motion of the rotor with the result that the contact stress will vary whereas if the sealing surface of the seal can be maintained tangent to the peripheral wall, this stress may be normalized at a minimum. An example of a seal arrangement adapted to accommodate the changing radius of a peripheral wall in a rotary machine is disclosed in U.S. Pat. No. 3,740,175, assigned to the assignee of this invention wherein there was provided a seal assembly which rocks in relation to the rotor. The present invention provides further improvement in apex sealing arrangements of this general type and comprises a pair of arcuate main body segments which are mounted in a cylindrical socket at each rotor apex and have outer convex edges engageable with the machine's inner peripheral wall. The inner edges of the main body segments in one embodiment have fingers and slots which mate to provide guided engagement between the two main body segments as they are biased apart to pivot in opposite directions to engage the peripheral wall by a spring which is positioned by a bar that slides on this wall, the spring having fingers which fit in end clearances between the engaged fingers and slots. In addition, there are provided arcuate end segments at the opposite ends of the main body segments that are biased by the spring fingers and wedged by the main body segments to engage the rotary machine' s end walls. This arrangement provides a very compact assembly which assures that the seal edges on the main body segments remain substantially tangent to the peripheral wall as the rotor turns by these segments rocking on the rotor with guided movement that insures their stabilization. Furthermore, this is accomplished with end wall sealing which provides for very tight sealing between the chambers at the rotor apexes.

An object of the present invention is to provide a new and improved rotary machine apex seal.

Another object is to provide in a rotary machine an apex seal having a plurality of segments whose movements are guided with respect to each other while they are biased to pivot to engage the machine's inner peripheral wall by a spring positioned by this wall so that their sealing surfaces remain substantially tangent thereto as the rotor turns.

Another object is to provide in a rotary machine an apex seal having a pair of main body segments which are biased to engage the machine's inner peripheral wall by a spring positioned by this wall such that their sealing surfaces remain substantially tangent thereto as the rotor turns and with there also being provided end segments at the opposite ends of the main body segments which are biased by the same spring and are wedged by the main body segments against the machine's oppositely facing inner end walls.

These and other objects of the present invention will become more apparent with reference to the following description and drawing in which.

Figure 1:
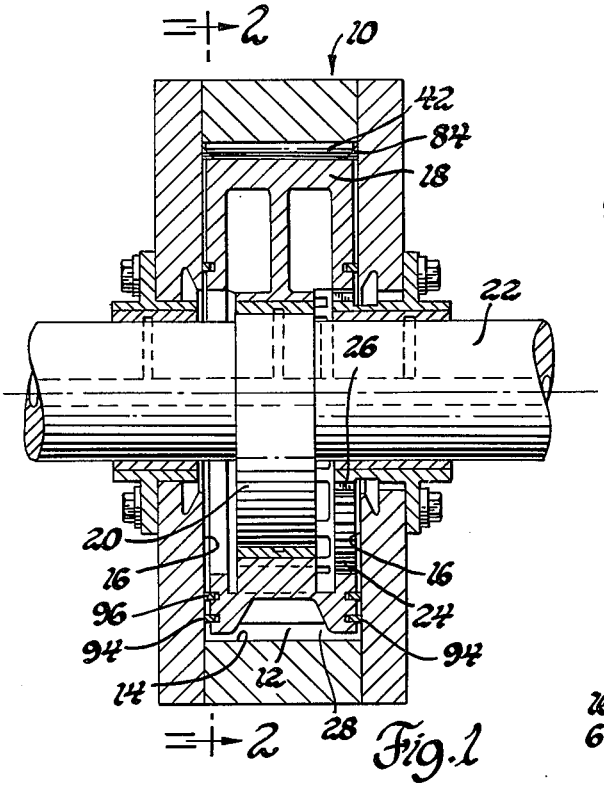
FIG. 1 is a side elevational view with parts in section of a rotary combustion engine having apex seals according to the present invention.
Figure 2:
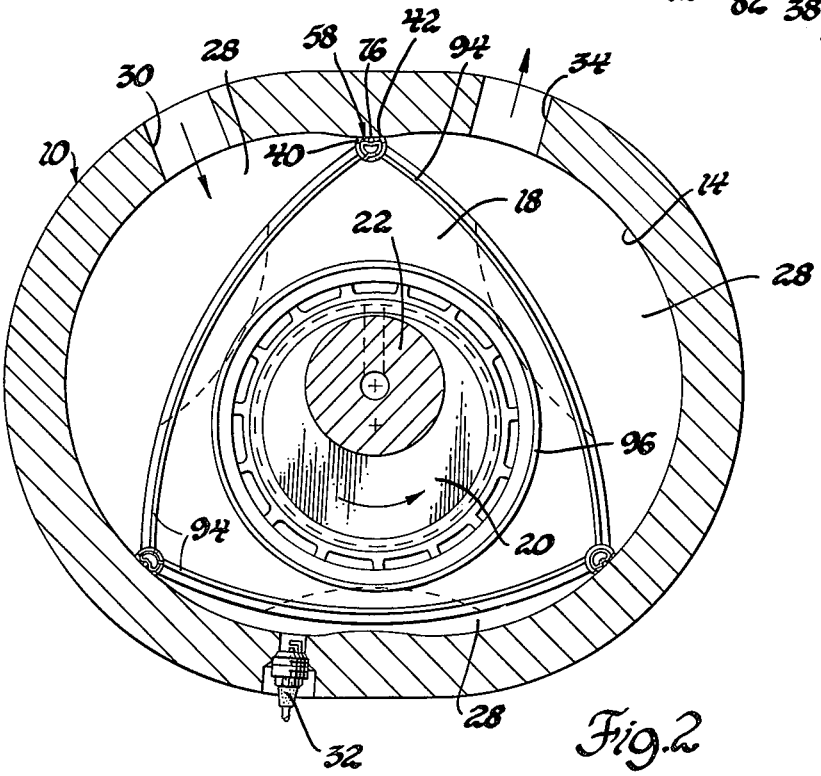
FIG. 2 is a view taken along the line 2—2 in FIG. 1.

The apex seal according to the present invention is for use in rotary machines including rotary combustion engines, compressors, pumps, and the like. Referring to FIGS. 1 and 2, the rotary machine may, for example, be an internal combustion rotary engine of the planetary type comprising a stationary outer body or housing 10 having a cavity 12 defined by an inwardly facing peripheral wall 14 and a pair of oppositely facing end walls 16. As best shown in FIG. 2, the peripheral wall is in the shape of a two-lobe epitrochoid or a curve parallel thereto and a rotor 18 having the general shape of an arcuate triangle is mounted in the cavity 12 on an eccentric 20 of a shaft 22 which is rotatably mounted in the housing as best shown in FIG. 1. An internal tooth rotary phasing gear 24 on one side of the rotor meshes with an external tooth stationary phasing gear 26 which is fixed as shown in FIG. 1 to the housing and has two-thirds the number of teeth as the gear 24 so that there is an enforced cyclic relation between the rotor and the shaft and the rotor faces cooperate with the peripheral wall and with the end walls to define three variable volume combustion or working chambers 28 that are spaced around and move with the rotor within the housing as the rotor rotates about its axis while planetating with respect to the shaft axis. An air-fuel mixture is delivered to the working chambers as they expand through an intake port 30 whereafter this mixture is then trapped and compressed and then ignited by a spark plug 32. After the powered expansion of the chambers, they eventually open to an exhaust port 34 to complete the cycle. The structure thus far described is conventional and operates efficiently assuming there is effective sealing between the working chambers of the engine.

Figure 3:
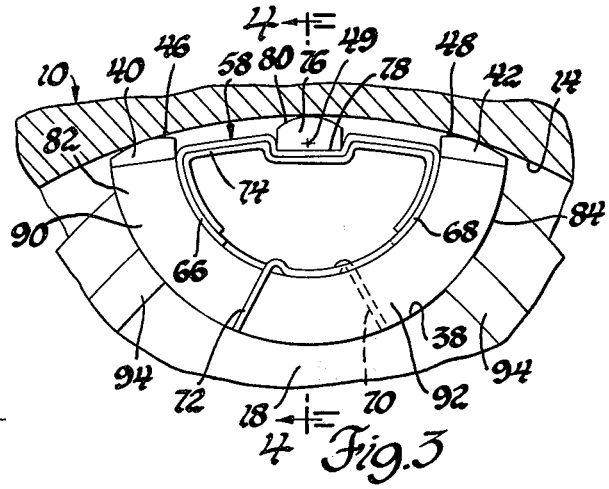
FIG. 3 is an enlarged view taken from FIG. 2 of one of the apex seals.
Figure 4:
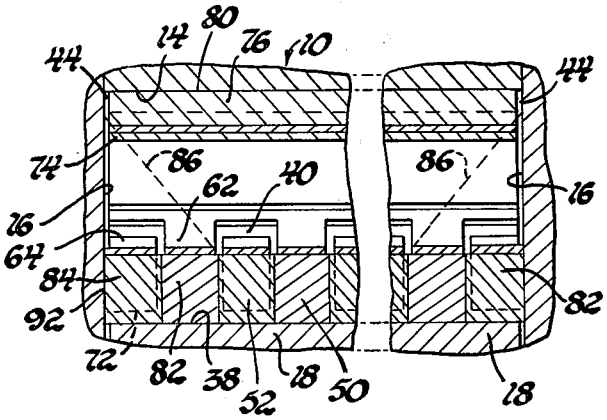
FIG. 4 is a view taken along the line 4—4 in FIG. 3.

Describing now the one embodiment of the apex seal according to the present invention shown in FIGS. 1 – 5, each apex or corner of the rotor has a cylindrical slot 38 of less than 180° extending the width thereof and facing radially outward toward peripheral wall 14. A pair of cylindrical main body seal segments 40 and 42 are slidably mounted in the slot 38 and extend almost the width of the peripheral wall 14, there being left sufficient end clearance 44 as shown in FIG. 4 to accommodate tolerances and heat expansion. The main body segments 40 and 42 have slightly rounded sealing surfaces 46 and 48, respectively, at their outer edges which engage with the peripheral wall 14 on pivotal movement about the center line 49 of slot 38 and these segments. The center line 49 is located on the inside of and parallel and close to the peripheral wall 14 as shown in FIG. 3 so that the sealing surfaces 46 and 48 will remain substantially tangent thereto as they pivot about this center in the socket provided by slot 38 to accommodate the peripheral wall's curvature which changes from convex at the waist to concave at the lobes and also to accommodate wear at their surfaces. To assure stability of the main body segments 40 and 42 as they rock in the slot 38 and also when substantial wear has occurred at their surfaces 46 and 48, there are provided tongues 50 and 52 and slots 54 and 56 on their oppositely facing inner edges which engage to provide a continuous sliding tongue and slot engagement therebetween as the main body segments pivot, the depth of this tongue and slot engagement being determined to exceed the maximum relative movement anticipated.

Figure 5:
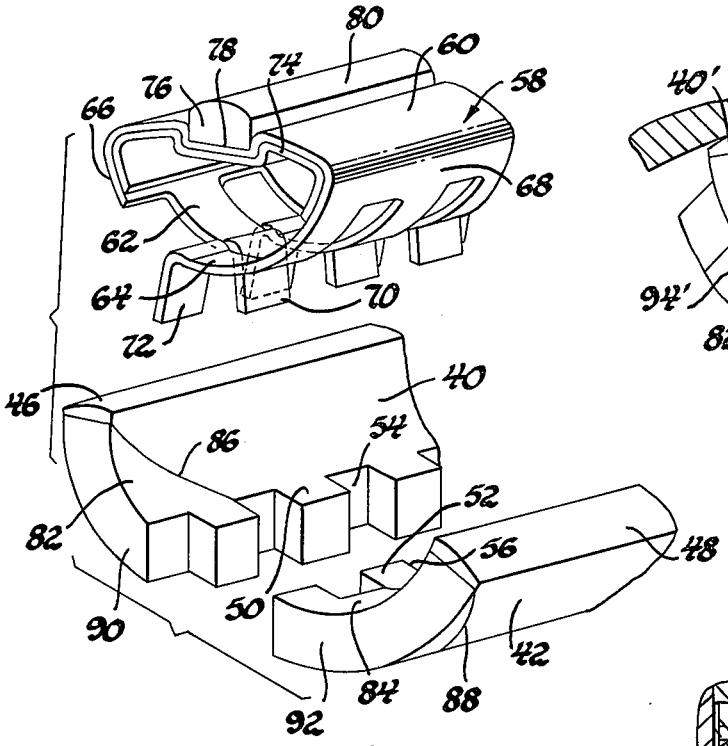
FIG. 5 is an exploded view of the apex seal in FIGS. 3 and 4.

The main body segments 40 and 42 are biased in opposite directions about the center line 49 to engage the peripheral wall 14 and are also held in proper relationship on the rotor by an assembly comprising a stamped sheet metal spring 58 that has a radially outwardly facing slightly convex side 60 that faces the peripheral wall and also has depending fingers 62 and 64 along the two longitudinally extending edges thereof. The respective fingers 62 and 64 have cylindrical portions 66 and 68 that fit against the inner cylindrical surface of the main body segments 40 and 42 and also have radially inwardly extending ends 70 and 72 which fit in end clearances provided between the ends of the tongues 50 and 52 and the respective slots 56 and 54. The spring 58 is prestressed on installation with the fingers 62 and 64 overlapping by a substantial amount and their ends 70 and 72 engage the ends of tongues 50 and 52 to bias the main body segment 42 counterclockwise and the other main body segment 40 clockwise as viewed in FIG. 3 to maintain the apex seal surfaces 48 and 46 against the peripheral wall 14 under all conditions. The spring 58 is reinforced by an inner stamped sheet metal segment 74 which is located within the spring and extends across the radially outwardly facing side 60 thereof and also extends a substantial distance inward along the cylindrical portions 66 and 68 as best seen in FIGS. 3 and 5. To hold the spring 58 and thereby the main body segments 40 and 42 in proper assembly in the socket 38 on the rotor apex there is provided a bar 76 which is mounted parallel to the peripheral wall 14 in a channel 78 formed in the outer side 60 of the spring 58 and the complementary side of the reinforcement member 74. The bar 76 has an outer rounded surface 80 that slides under slight load on the peripheral wall 14 and thereby maintains the desired location of the spring 58 and thus retains the entire apex seal assembly properly together on the rotor. Furthermore, the bar 76 also provides additional apex sealing.

In addition to the sealing thus provided between the rotor apexes and the peripheral wall, there are provided end segments 82 and 84 which meet at the opposite ends of the main body segments 40 and 42 with helical interfaces 86 and 88 as best shown in FIGS. 4 and 5. The end segments 82 and 84 have continuations of their main body segments' cylindrical surfaces and also the tongue and slots so that they are each engaged by a spring finger to also pivot about the center line 49 in opposite directions. The helical interfaces 86 and 88 are of opposite twist and are directed so that they force or wedge the end segments 82 and 84 axially outward in response to this spring bias to engage the flat arcuate end faces 90 and 92 thereof with the oppositely facing end wall 16. Sealing of the working chambers 28 is completed by arcuate side seals 94 which are mounted in accommodating grooves in the rotor sides and are biased to engage the oppositely facing end wall 16. The side seals 94 extend adjacent the rotor faces and have their ends engaging the outer cylindrical surfaces of the apex seal end pieces 82 and 84 as shown in FIGS. 2 and 3. In addition, a circular oil seal 96 is mounted inboard of the side seals 94 in each rotor side concentric with the rotor and is biased to engage the oppositely facing end wall to prevent the oil used for lubrication and cooling from reaching any further outward.

Figure 6:
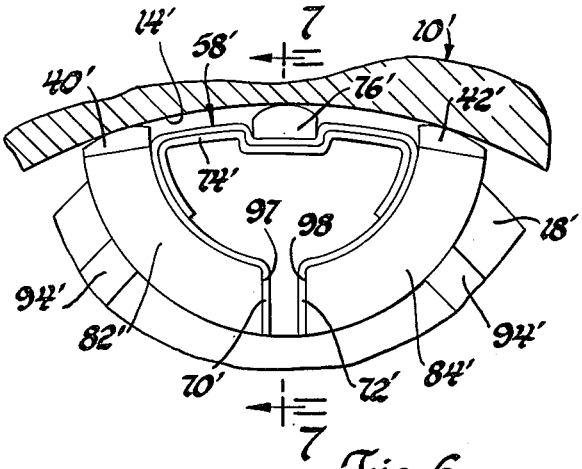
FIG. 6 is a view similar to FIG. 3 showing another embodiment of the apex seal according to the present invention.
Figure 7:
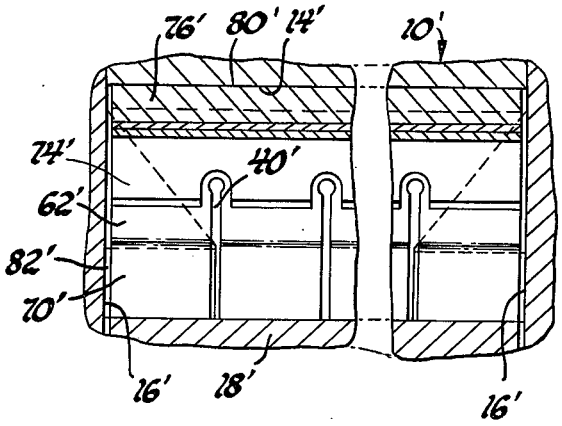
FIG. 7 is a view taken along the line 7—7 in FIG. 6.
Figure 8:
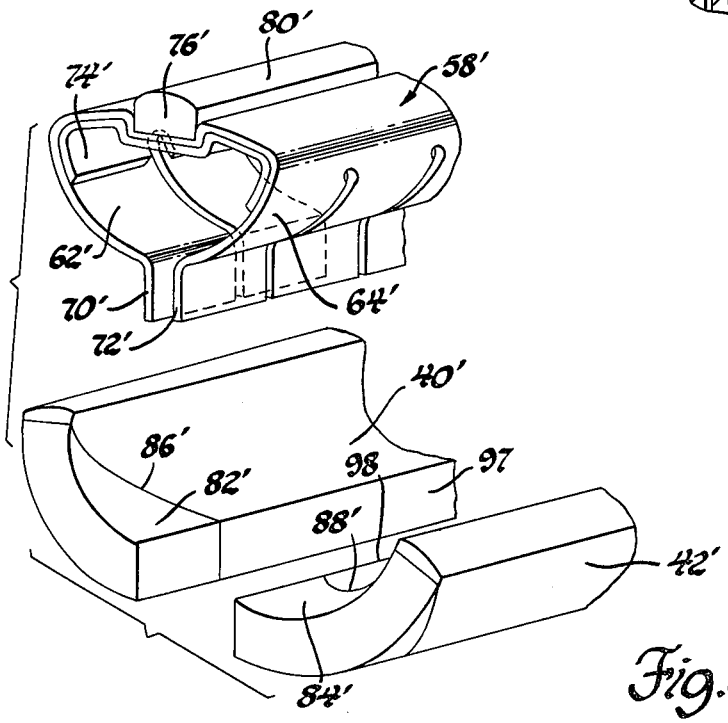
FIG. 8 is an exploded view of the apex seal in FIGS. 6 and 7.

In the other embodiment of the apex seal according to the present invention shown in FIGS. 6 – 8 wherein parts similar to those in the first embodiment are identified by the same numbers only primed and different structure is identified by new numbers, the sliding tongue and slots are omitted where the range of pivotal movement and/or wear of the apex seal segments is substantially less and instead the main body segments 40′ and 42′ and their respective end pieces 82′ and 84′ with the mating helical interfaces 86′ and 88′ have flat uninterrupted inner edges 97 and 98 which extend substantially radially inward as best shown in FIG. 6. In addition, the spring 58′ with the bar 76′ operating as before is modified as best shown in FIGS. 7 and 8 such that the ends 70′ and 72′ of fingers 62′ and 64′ are now arranged opposite each other between the oppositely facing flat inner edges 97 and 98 with the outboard ones engaging the now unnotched inner edges of end pieces 82′ and 84′ to force the wedging action that urges them outward against the opposite end wall.

The above described embodiments are illustrative of the invention which may be modified within the scope of the appended claims.

We claim:

1. In a rotary machine, a rotor housing having an internal peripheral wall and oppositely facing end walls, a rotor rotatable between said end walls relative to said peripheral wall, said rotor having apexes that remain adjacent said peripheral wall as said rotor rotates, and seal means for continuously providing sealing between said peripheral wall and each apex of said rotor as said rotor rotates comprising a pair of cylindrical main body segments mounted in a cylindrical slot at each apex of said rotor for pivotal movement in opposite directions about a centerline inside of and adjacent said peripheral wall, each said main body segment having an outer curved edge for engaging said peripheral wall and an inner edge opposite the corresponding edge of the other main body segment, an end segment at each end of each said main body segment and also having an inner edge and mounted in said cylindrical slot for pivotal movement about said centerline, said end segments and adjoining main body segments having mating interfaces angled so that pivotal movement of said end segments in the direction of said peripheral wall also causes movement of said end segments outward against the opposite end wall, and spring means retained in position at each apex on said rotor by said peripheral wall engaging the inner edges of both said main body segments and said end segments for biasing said main body segments in opposite pivotal directions to engage said outer edges with said peripheral wall and also biasing said end segments in opposite pivotal directions so that said mating interfaces wedge said end segments outward against the opposite end wall.

2. In a rotary machine, a rotor housing having an internal peripheral wall and oppositely facing end walls, a rotor rotatable between said end walls relative to said peripheral wall, said rotor having apexes that remain adjacent said peripheral wall as said rotor rotates, and seal means for providing sealing between said peripheral wall and each apex of said rotor as said rotor rotates comprising a pair of cylindrical main body segments mounted in a cylindrical slot at each apex of said rotor for pivotal movement in opposite directions about a centerline inside of and adjacent and parallel to said peripheral wall, each said main body segment having an outer curved edge for engaging said peripheral wall and an inner edge opposite the corresponding edge of the other main body segment, an end segment at each end of each said main body segment and also having an inner edge and mounted in said cylindrical slot for pivotal movement about said centerline, said end segments and adjoining main body segments having mating interfaces angled so that pivotal movement of said end segments in the direction of said peripheral wall also causes movement of said end segments outward against the opposite end wall, a spring having fingers engaging the inner edges of said main body segments and said end segments to bias said main body segments in opposite pivotal directions to engage said outer edges with said peripheral wall and also to bias said end segments in opposite pivotal directions so that said mating interfaces wedge said end segments outward against the opposite end wall, and a bar mounted on said spring and sliding on said peripheral wall to maintain said segments in position on said rotor and also supplement the sealing provided by said main body segments.

* * * * *